US008868014B2

(12) United States Patent
Krivokapic

(10) Patent No.: US 8,868,014 B2
(45) Date of Patent: Oct. 21, 2014

(54) IMMERSIBLE UHF ANTENNA WITH LOW POWER AUTO TUNING SYSTEM

(75) Inventor: Ivan Krivokapic, San Diego, CA (US)

(73) Assignee: Olympus Corporation, Tokyo (JP)

( * ) Notice: Subject to any disclaimer, the term of this patent is extended or adjusted under 35 U.S.C. 154(b) by 698 days.

(21) Appl. No.: 13/230,676

(22) Filed: Sep. 12, 2011

(65) Prior Publication Data

US 2013/0065545 A1 Mar. 14, 2013

(51) Int. Cl.
*H01Q 11/12* (2006.01)
*H01Q 9/04* (2006.01)

(52) U.S. Cl.
CPC ..... *H01Q 9/0421* (2013.01); *H01Q 9/0442* (2013.01)
USPC ..... 455/121; 455/77; 455/120; 455/193.1; 455/268; 455/272

(58) Field of Classification Search
CPC ..... H01Q 9/0421; H01Q 9/0442; H04B 1/525
USPC ..... 455/77, 120, 121, 115.2, 115.3, 125, 455/127.1, 134, 150.1, 193.1, 268, 272
See application file for complete search history.

(56) References Cited

U.S. PATENT DOCUMENTS 5,999,138 A * 12/1999 Ponce de Leon ..... 343/745
6,081,700 A * 6/2000 Salvi et al. ..... 455/193.3
6,198,441 B1 * 3/2001 Okabe et al. ..... 343/702

* cited by examiner

*Primary Examiner* — Tuan Pham
(74) *Attorney, Agent, or Firm* — Sheppard Mullin Richter & Hampton LLP

(57) ABSTRACT

An antenna is provided having a good matching characteristics when immersed in a fluid such as saline water, oil, or other liquids ("the phantom liquid"). In some embodiments, the antenna provides a tight capacitive coupling with the phantom liquid through the use of a higher permeability cover and absence of a gap between the cover and the antenna body. One embodiment employs a tunably capacitively loaded inverted "F" antenna structure. Additional embodiments of the invention provide an antenna tuning system that saves power by utilizing very low duty cycle periodical refreshing charge at a tuning varactor diode coupled to the antenna.

14 Claims, 9 Drawing Sheets

IMMERSIBLE UHF ANTENNA WITH LOW POWER AUTO TUNING SYSTEM

TECHNICAL FIELD

The present invention relates generally to antennas and antenna tuning systems, and more particularly, some embodiments relate to tunably capacitively loaded antennas that are immersible in a fluid and associated tuning systems.

DESCRIPTION OF THE RELATED ART

The necessity for impedance matching between transceiver circuitry and the connected antenna is well understood in the art of radio communications. The input and output impedance of the antenna depends upon the antenna's environment. For example, an antenna surrounded by air has significantly different impedance characteristics than one immersed in a liquid such as saline water or an oil. Additionally, the location and nature of other objects in the environment effect these characteristics.

BRIEF SUMMARY OF EMBODIMENTS OF THE INVENTION

According to various embodiments of the invention, an antenna is provided having a good matching characteristics when immersed in a fluid such as saline water, oil, or other liquids ("the phantom liquid"). In some embodiments, the antenna provides a tight capacitive coupling with the phantom liquid through the use of a higher permeability cover and absence of a gap between the cover and the antenna body. One embodiment employs a tunably capacitively loaded inverted "F" antenna structure. Additional embodiments of the invention provide an antenna tuning system that saves power by utilizing very low duty cycle periodical refreshing charge at a tuning varactor diode coupled to the antenna.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1A:
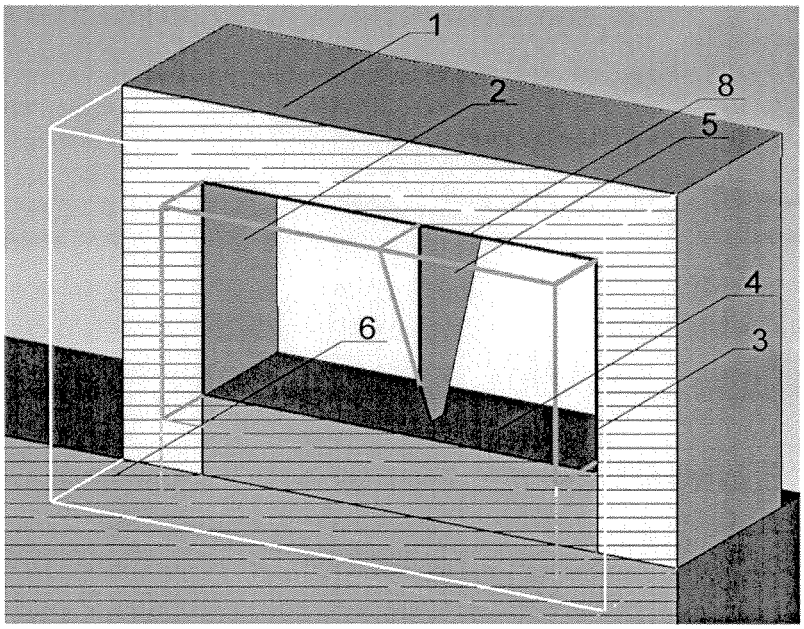
FIGS. 1A-1D illustrate various aspects of an inverted "F" antenna implemented in accordance with an embodiment of the invention.
Figure 1B:
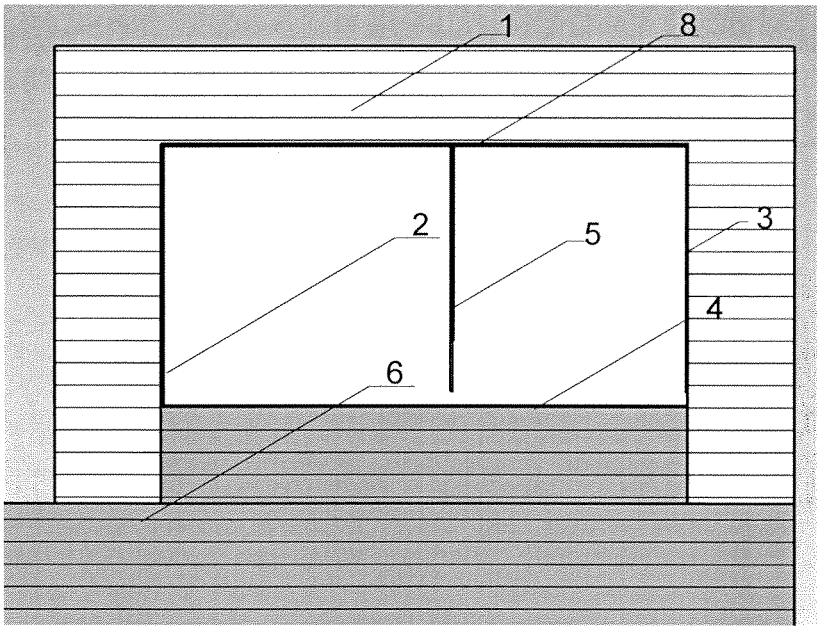
Figure 1C:
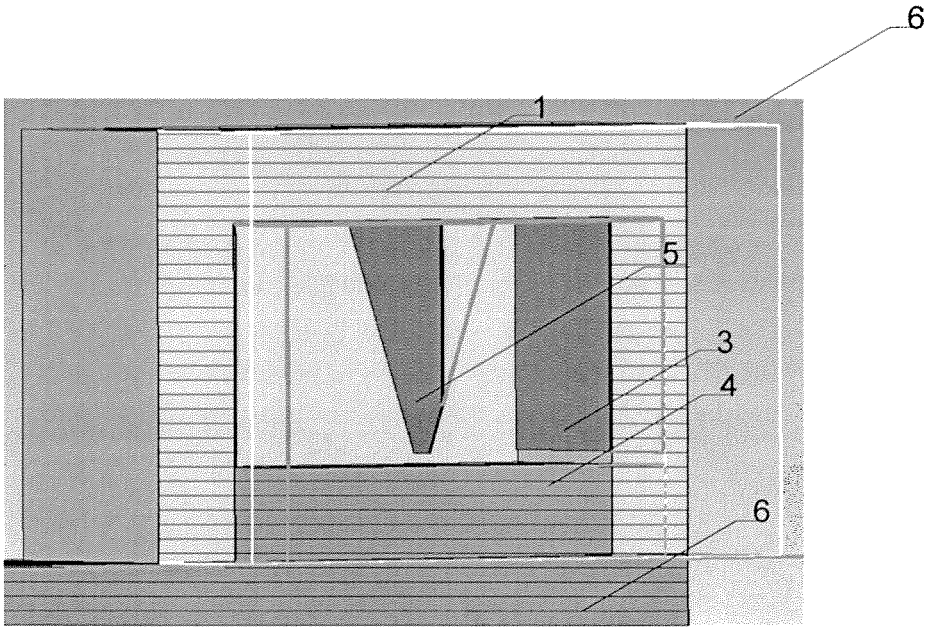
Figure 1D:
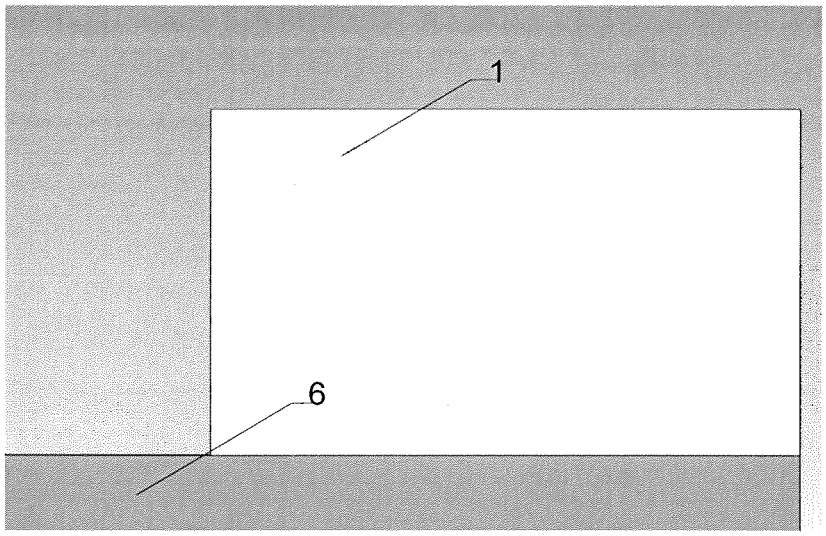

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a system and method for providing a management system for materials handling. In one embodiment Before describing the invention in detail, it is useful to describe a few example environments with which the invention can be implemented. One such example is that of implantable radio sensor for biologicial tissues. Another example is a immersible radio sensor for liquids parameters monitoring.

FIGS. 1A-1D illustrate various aspects of an inverted "F" antenna implemented in accordance with an embodiment of the invention. The antenna comprises an interconnecting rail 8, which radiates and provides an electrical coupling between further antenna elements.

The illustrated antenna further comprises a grounding element 2 extending from a first end of the interconnecting element 8. The grounding element is coupled to an electrical ground. In the illustrated embodiment, the ground is provided by a connection to a metal pedestal 4 that is bonded to a metal made application electronics package 6. In alternative embodiments, other methods of grounding the grounding tab 2 may be implemented.

The illustrated antenna embodiment further comprises a matching element 3 extending from the opposite end of the interconnecting rail 8. As illustrated below, the matching element is coupled to a varactor, providing a tunable capacitive load. In one embodiment, the matching element 3 has a variable capacitive load between 4.5-5 pF. In some embodiment, the particular capacitance may be determined through the use of an antenna tuning system as described below. In other embodiments, where the antenna is utilized separately from the particular tuning systems described herein, the matching capacitance may be determined in other ways.

The illustrated embodiment further comprises a feed element 5 extending from the interconnecting rail from a location between the ends of the rail 8. In the illustrated embodiment, the feed element 5 is coupled to an electrical interconnect, such as a coaxial cable. This embodiment of the feed element 5 has a generally triangular shape, tapering from its widest point where it connects to the interconnecting rail 8 to a narrowest point where it connects to the electrical interconnect.

In some embodiment, the metal components of the antenna (rail 8, ground element 2, feed element 5, and matching element 3) may be a single unitary metal body. In other embodiments, the components may be separate bodies connected together in various manners.

In this embodiment, the antenna is covered by a dielectric material 1 that enabling a tight capacitive coupling with the environment. For example, in one embodiment, the covering 1 comprises silicon. In other embodiments, materials such as nylon may be employed. The capacitive coupling with the environment is further enhanced by avoiding a gap between the rail 8, the grounding tab 2, and the matching element 3. In some embodiments, the interior space of the antenna, defined by the other side of the rail 8, ground element 2, and matching element 3, may be tilled with air or other suitable dielectric.

A particular embodiment of the inverted "F" antenna is configured to operate in a frequency range between about 390 MHz and 420 MHz. In this embodiment, the silicon cover is 3.75 mm thick at the top above the rail 8, 2.75 mm thick at the narrow antenna side near the matching element 3, and 4 mm thick at the wide antenna side near the grounding element 2. In this embodiment, the metal pedestal 4 is 3 mm thick, the ground element 2 and matching element 3 are 10 mm wide and 10 mm high, the interconnecting rail 8 is 10 mm wide and 20 mm long, and the feed element 5 is 10 mm high and 10 mm wide at its base, tapering to 2 mm wide at the point farthest from the rail 8. In this embodiment, the feed element 5 is spaced 11 mm from the grounding tab 2. Other embodiments may differ from these measurements according to desired frequency range and other design considerations.

Figure 2:
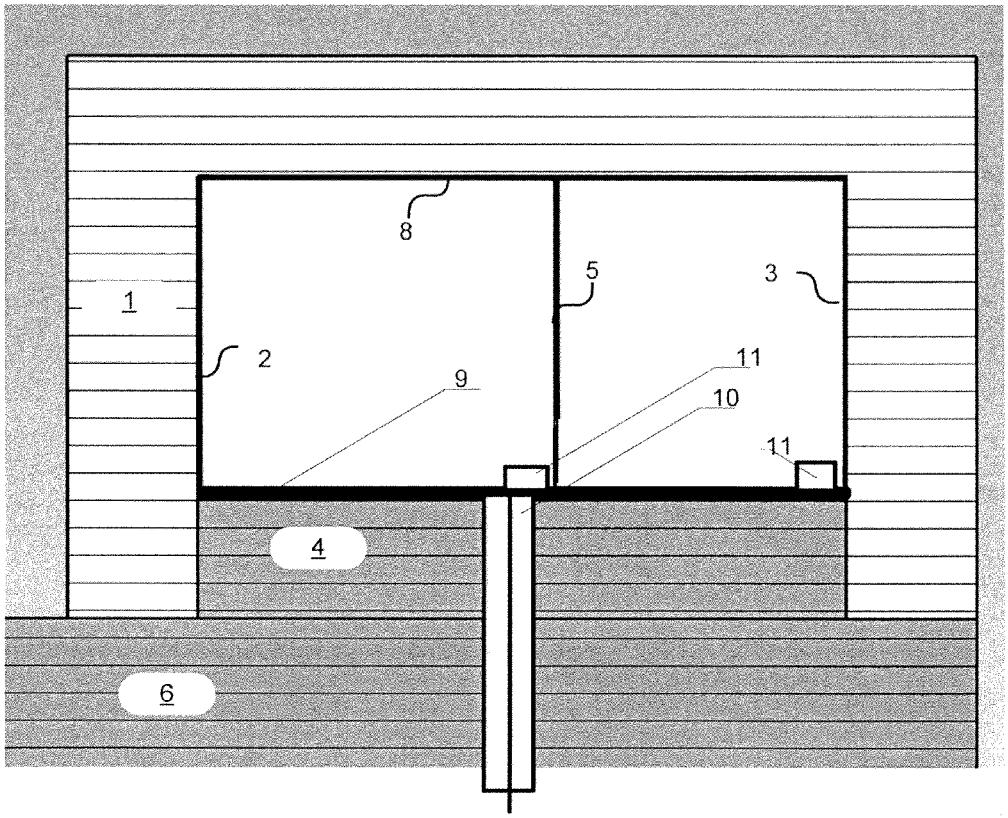
FIG. 2 illustrates the antenna feed structure of an embodiment of an inverted antenna.

FIG. 2 illustrates the antenna feed structure of an embodiment of an inverted "F" antenna. In this embodiment, the electrical interconnect feeding the antenna feed element 5 comprises coaxial cable 10. The feed element 5 and matching element 3 are coupled to antenna electronic components 11, which are connected to the electrical interconnect 10. These electronic components 11 are described in further detail below. The electronic components 11 and and antenna elements 2, 8, 5 3 are interconnected through the trough the printed wire board 9, provided by the metal pedestal 4 and package 6.

The illustrated antenna design favors tighter capacitive coupling with the surrounding liquid environment. This coupling is primarily achieved by means of a higher relative permittivity cover 1 and an absence of a gap between the cover walls 1 and the antenna body. Typical materials for the cover 1 include, such as silicone (silicon rubber), silicon, nylon or other materials having a relative permittivity between 3 and 11. This approach may effectively increase antenna aperture, providing relatively good antenna gain performances.

Figure 3:
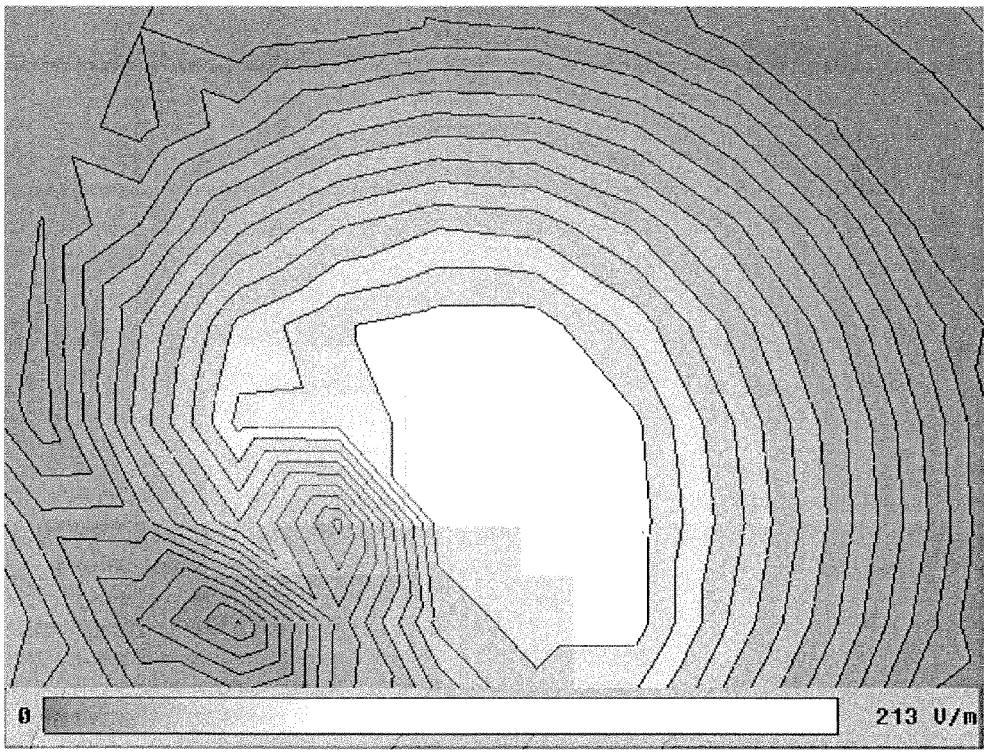
FIG. 3 illustrates a simulation of the E-field distribution around an immersed antenna implemented in accordance with an embodiment of the invention.

FIG. 3 illustrates a simulation of the E-field distribution around an immersed antenna implemented in accordance with an embodiment of the invention. Here, the particular embodiment described above was simulated in a phantom fluid with $\in r=57.17$, $s=0.93$ S/m. This simulation illustrates the capacitive coupling effect described above. The E-field has a relatively uniform distribution across a significant area around the antenna.

Figure 4:
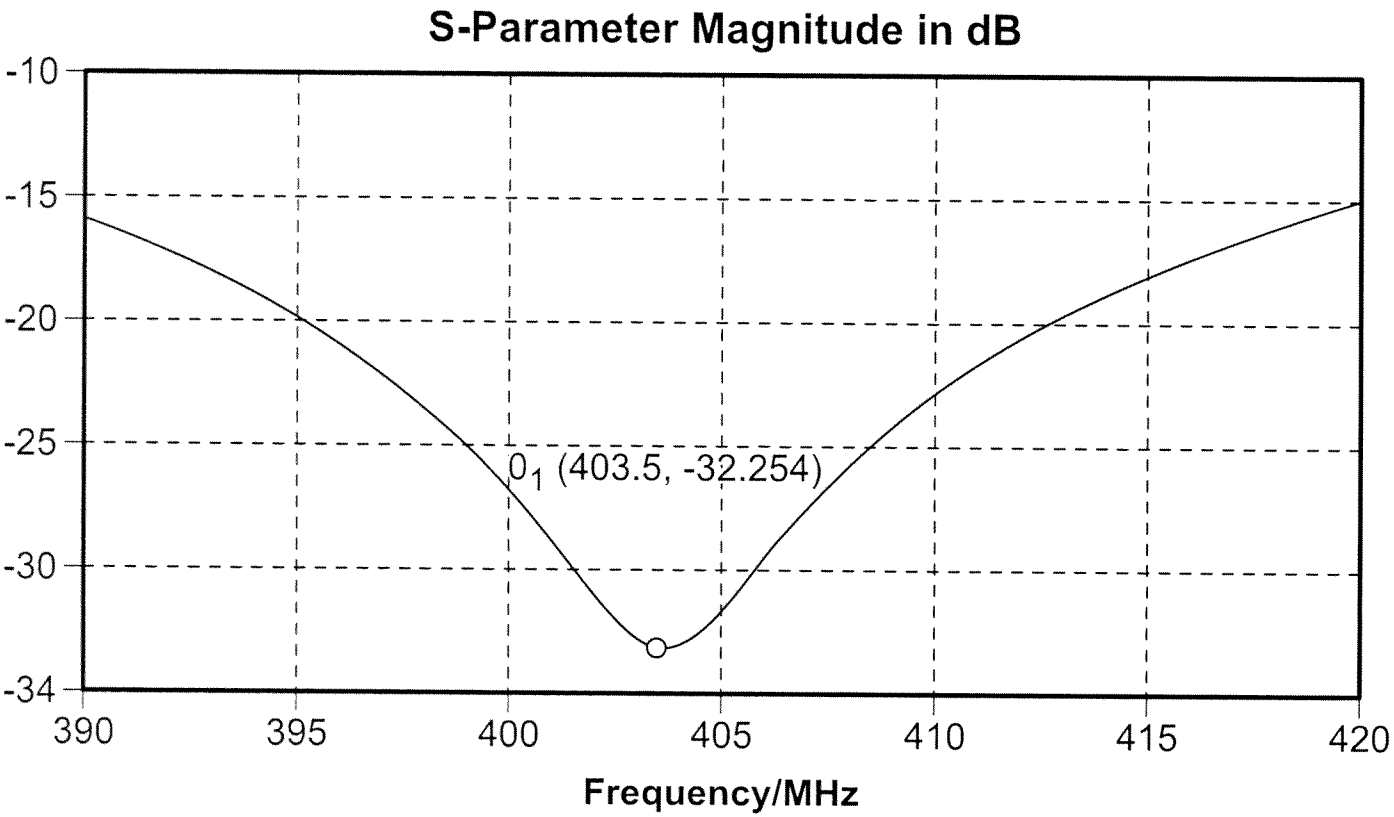
FIG. 4 illustrates simulated immersed antenna return loss for the particular embodiment discussed with respect to FIG. 3.

FIG. 4 illustrates simulated immersed antenna return loss for the particular embodiment simulated with respect to FIG. 3. The same phantom liquid characteristics were used in this simulation. This simulation illustrates that, due to the electrically lossy liquid dielectric properties, the Q-factor of the antenna is reduced, providing a good match across a wide frequency range.

Figure 5:
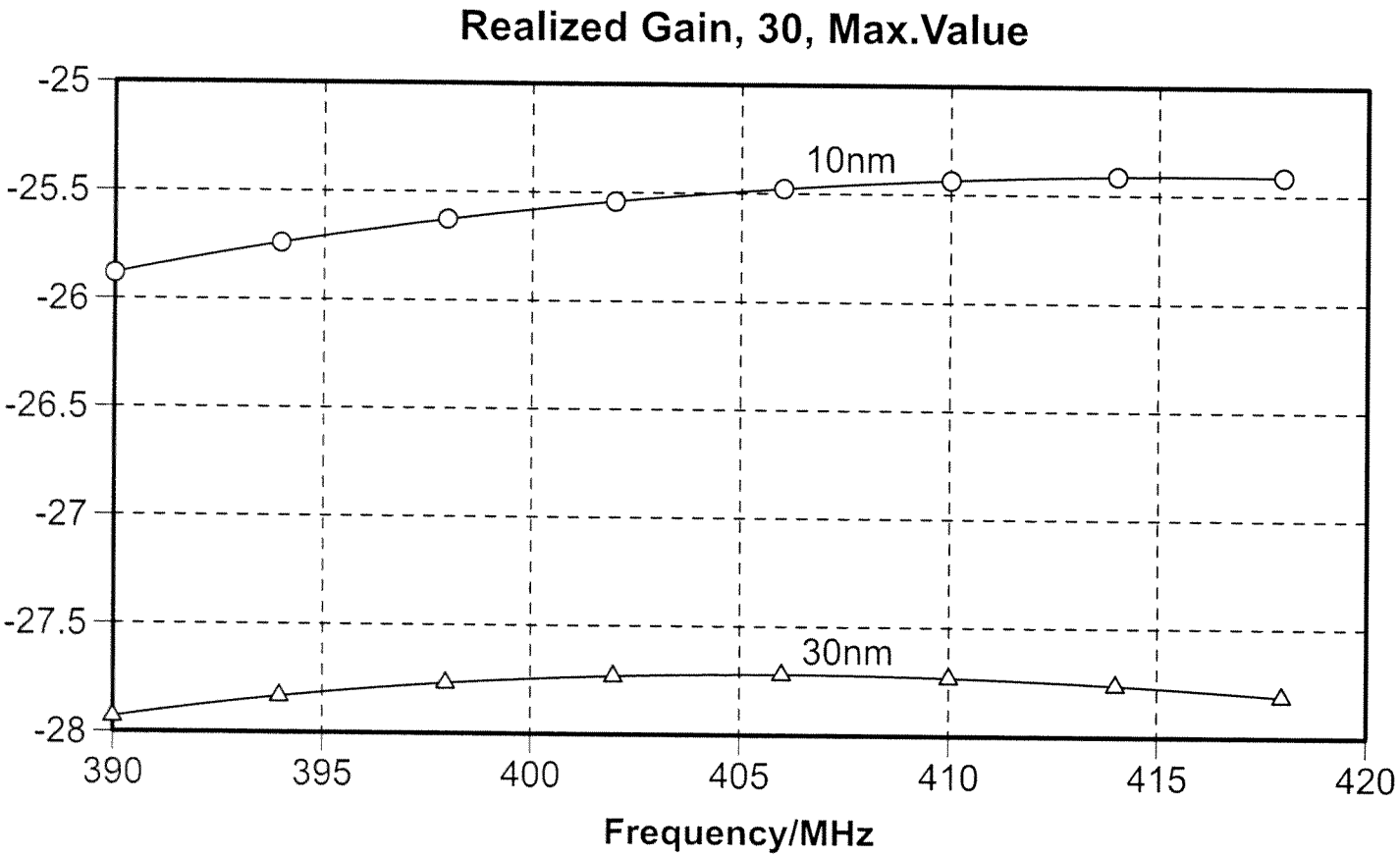
FIG. 5 illustrates simulations of this embodiment of realized maximum antenna gain versus frequency antenna gain vs. frequency, at 10 and 30 mm from the phantom wall, respectively.

FIG. 5 illustrates simulations of this embodiment of realized maximum antenna gain versus frequency antenna gain vs. frequency, at 10 and 30 mm from the phantom wall, respectively.

Figure 6:
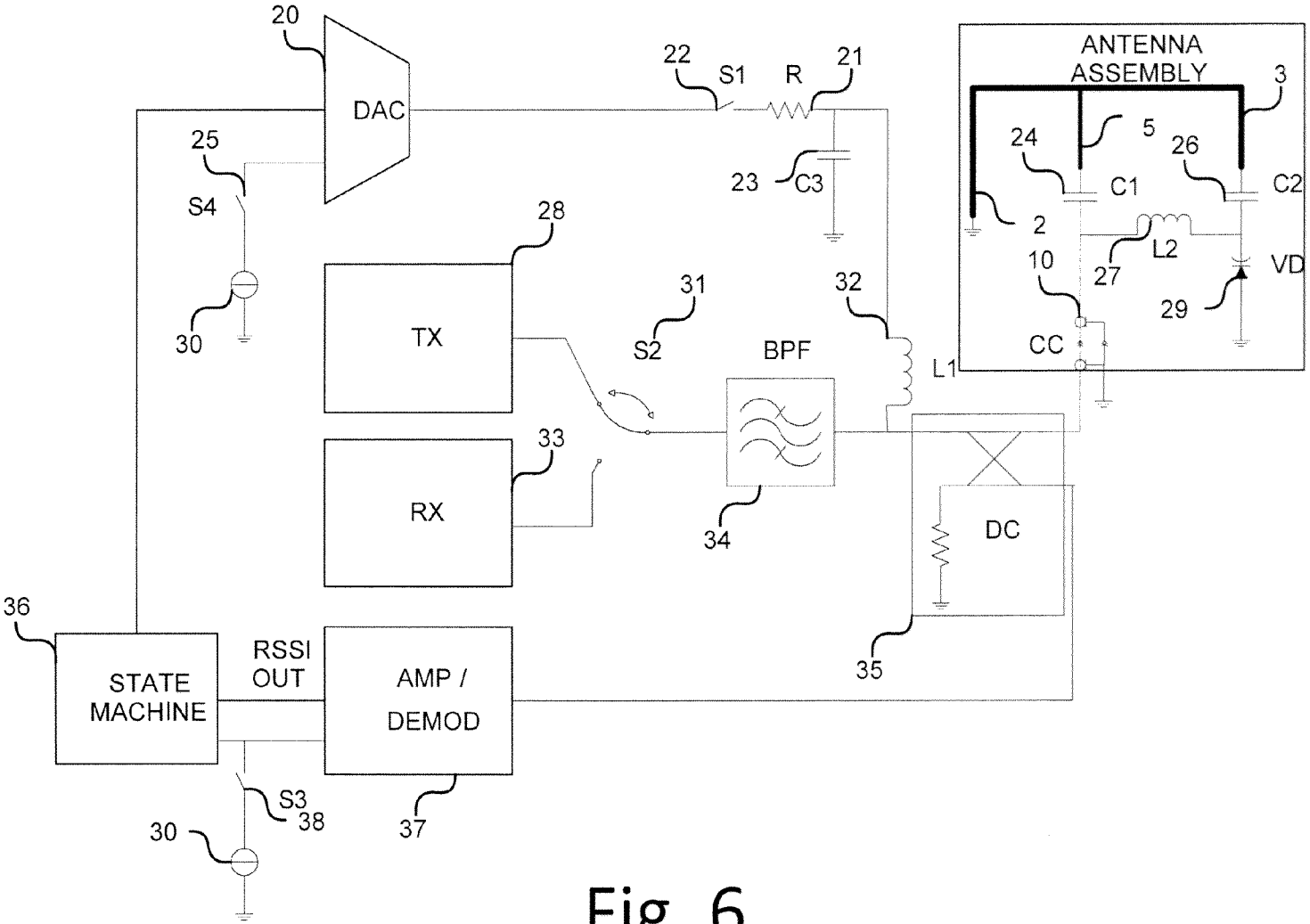
FIG. 6 illustrates a circuit diagram of an antenna and antenna tuning system implemented in accordance with an embodiment of the invention.

FIG. 6 illustrates a circuit diagram of an antenna and antenna tuning system implemented in accordance with an embodiment of the invention. In this embodiment, the antenna tuning system is integrated with the transmit/receive system. In this embodiment, the antenna assembly comprises an antenna as illustrated in FIGS. 1 and 2. However, in other embodiments, other capacitively tuned antennas may be embodiments may be employed.

As discussed above, in addition to the elements described with respect to FIGS. 1 and 2, the illustrated embodiment of the antenna assembly includes electronic components 11 assembled on printed wire board 9. In this embodiment, the electronic components include a capacitor 26, C2, coupled to the matching element 3, and a varactor diode 29, VD, coupled to C2 26. These components provide the adjustable capacitive loading described herein.

Additionally, in this embodiment, the components further comprise a DC decoupling inductor 27, L2. In some embodiments, the DC control voltage to control the varactor 29 is carried by the same line 10 as the antenna signal. The decoupling inductor 27 separates the DC control voltage for the varactor 29 from the signal for feed element 5. The feeding cable is connected through decoupling capacitor 24 that decouples the RF signal from the varactor DC control voltage.

The transceiver system comprises a transmitter 28 coupled to the electrical interconnect. In the illustrated embodiment, the system is a transceiver with transmitter 28 and receiver 33 subsystems. A switch 31 controls connection of the transmitter 28 or receiver 33 to the antenna assembly. Other embodiments may be implemented as transmitters only, without receive capability, and the receiver 33 may be omitted. A bandpass filter 34 is used to couple the transmitter 28 and receiver 33 to the antenna assembly through a directional coupler 35. In this embodiment, the band pass filter 34 and transmitter are implemented to be AC decoupled from the ground. In this embodiment, both the transmitter 28 and receiver 33 share a common band pass filter 34. In other embodiments, separate filters may be employed for the transmitter 28 and receiver 33.

The transceiver system further comprises an auto tuning system. The auto tuning system includes a tuning module configured to provide a control voltage to the antenna assembly. In this embodiment, the tuning module comprises a digital to analog converter 20 (DAC).

In the illustrated embodiment, the control voltage for the varactor 29 is passed from the DAC 20 through a switch 22, S1, through a low pass filter comprising resistor 21, R, and capacitor 23, C3, through a high frequency decoupling inductor 32, L1, and through the directional coupler 35.

In some embodiments, auto tuning system further comprises a signal strength determination module. In the illustrated embodiment, the signal strength determination module comprises a dedicated amplifier/envelope demodulator and digitized relative signal strength indicator (RSSI) 37. The RSSI 37 measures the relative signal strength of reflected power during a calibration process, as described below. The output of the RSSI 37 is passed to a DC control voltage determination module, in this case a state machine 36, to provide a digital signal to the Digital to Analog Converter (DAC) 20 to provide a control voltage for varactor 29.

In the illustrated embodiment, the DAC 20, state machine 36, and RSSI 37 are powered by power source 30, for example, a common power bus. A first switch 25 is interposed between power source 30 and DAC 20 while a second switch 38 is interposed between both state machine 36 and RSSI 37. As discussed below, during operation, the ability to selectively power DAC 20 independently of state machine 36 and RSSI 37 allows some measure of power saving.

Figure 7:
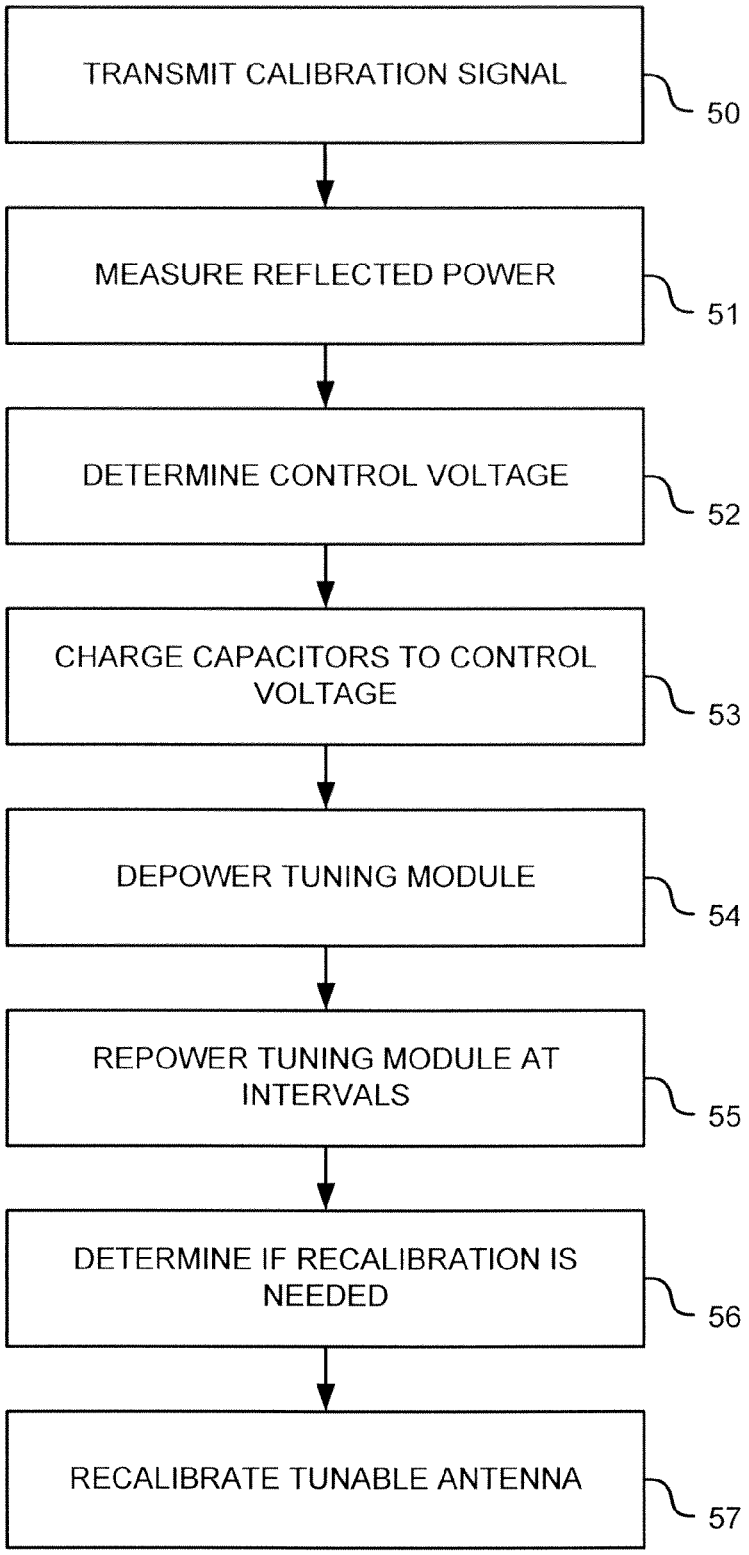
FIG. 7 describes tuning and normal operation of the transceiver system illustrated in FIG. 6.

In the embodiment described in FIG. 7, an initial antenna tuning calibration begins with transmission of a calibration signal 50. In this step, the transmitter 28 transmits a predetermined calibration signal using the antenna assembly. For example, in one embodiment, the calibration signal comprises a tone at predetermined frequency and power level, such as the maximum power available to transmitter 28.

During transmission of the calibration signal, amount of power reflected by the antenna assembly, which is proportional to the power at coupled port of DC 35. In step 51, a signal strength determination module, such as RSSI 37, measures the reflected power and outputs a measurement of the reflected power to allow a tuning module to output a control voltage for varactor 29.

In step 52, the measured reflected power is used to determine the control voltage for the antenna assembly. In one embodiment, the tuning module determines appropriate control voltage by implementing a binary search algorithm with iterative adjustment of potential control voltages. For example, in one embodiment, the tuning module comprises a state machine 36 coupled to DAC 20. A binary search algorithm may be used to determine a control voltage for the varactor 29 that minimizes reflected power, or reduces reflected power below a predetermined threshold.

In step 53, the control voltage is output by the tuning module, thereby charging the capacitors and varactor 29 to the control voltage. Modern varactors, such as hyperabrupt varactors have very low inverse currents, particularly at around 1 V. Accordingly, in some embodiments, the varactor 29 is operated at a charge level having very low inverse current, allowing the residual tuning control voltage to be maintained by the capacitors and varactor without significant change for a relative long time. Accordingly, in step 54, the tuning module may be depowered, for example by disconnecting switch S1 22, and, optionally, switch s4 25. As the residual charge drains from the circuit, the antenna will slowly become de-tuned. However, due to the conductive nature of the surrounding liquid environment, the antenna operates at a low Q-factor, and is relatively insensitive to de-tuning.

At various intervals, the tuning module may be re-powered during step 55 to recharge the tuning circuit. In one embodiment, the digital value corresponding to control voltage is stored in an internal register in DAC 20. Accordingly, recharging the tuning circuit may comprise connecting switch S4 25 and S1 22, and providing the control voltage without using state machine 36 and RSSI 37. In one embodiment, the intervals between recharging events may be determined according to the electrical characteristics of the various circuit elements. One example of such a determination is provided below.

At further intervals, for example, during a subsequent operational period, or a subsequent calibration transmission event, at step 56, the circuit may determine if a re-tuning is necessary. In other embodiments, an external control signal may be provided to initiate a re-tuning process. In one embodiment, the output of the RSSI corresponding to the final reflected power level of the last tuning process is stored in a second internal register. To determine if a subsequent re-tuning is necessary, the transmitter may transmit the calibration signal, with the last control voltage applied to the antenna assembly. If the reflected power, measured by the output of the RSSI 37, differs from the last saved RSSI level by a predetermined amount, then retuning may be initiated. If retuning is initiated in step 57, the process continues with a binary search at state machine 36 to determine a new control voltage.

In one embodiment, the time between consecutive varactor control voltage refresh cycles $\Delta t_v$ is covered by following considerations. Varactor capacitance $C_v$ along with $C_2$ determines equivalent capacitive loading of antenna. Changes of this equivalent capacitance cause antenna retuning. Dependence of antenna frequency retuning and equivalent capacitive loading is given by $$\left(\frac{\delta f_0}{f_0}\right)^2 = \frac{C_2 + \varepsilon C_v}{\varepsilon(C_2 + C_v)} \tag{1}$$

where $f_0$ is the initial frequency, $\delta$ is frequency shift factor due to varactor capacitance change $\in$.

Formula (1) yields and explicit expression for $\in$:

$$\varepsilon = \frac{1}{\delta^2\left(1 + \frac{C_v}{C_2}\right) - \frac{C_v}{C_2}}. \tag{2}$$

Total capacitance $C_\in$ in antenna assembly and transceiver circuitry is given by:

$$C_\in = C_1 C_2 + C_3 \tag{3}.$$

The charge change in initially loaded capacitors due to dominant varactor diode reverse current discharge is given by:

$$i_r \Delta t_v = (C_\in + C_{v0}) v_0 - (C_\in + \in C_{v0}) v_f \tag{4},$$

where $i_r$ is the varactor reverse current, the initial voltage at varactor is $v_0$, voltage at varactor at the end of process is $v_f$, and $C_{v0}$ is the initial varactor capacitance.

For very small changes of varactor voltage, one can assume linear dependence of tuning voltage and varactor capacitance change in vicinity of varactor operation voltage. For that reason one can introduce coefficient $\alpha$ defined for a particular small segment:

$$\alpha = \frac{v_v}{C_v}, \quad \Delta v_v << \Delta v_{vmax}. \tag{5}$$

Introducing (5) into equation (4) yields:

$$i_r \Delta t_v = (C_e + C_{v0})\alpha C_{v0} - (C_e + \varepsilon C_{v0})\frac{\alpha C_{v0}}{\varepsilon}. \tag{6}$$

Finally equation (7) provides the dependency between time needed between varactor control voltage refresh cycles $\Delta t_v$, versus control circuitry capacitance, antenna assembly capacitance, varactor capacitance change and reverse current of varactor:

$$\Delta t_v = \alpha \frac{C_e C_{v0}}{i_r}\left(1 - \frac{1}{\varepsilon}\right). \quad (7)$$

As a practical example, assume capacitive loading of antenna to be 4.5 pF at central operating frequency of 403.5 MHz. In a particular embodiment the varactor 29 may comprise varactor diode model number BB837 sold by Infineon, with a biasing voltage of 1.3V. The diode capacitance is 6 pF at this bias. The series capacitance $C_2$ is then 18 pF. Further assume that 0.1 dB gain penalty due to the detuning is acceptable. This assumes around 1% antenna tune frequency drift toward lower side ($\delta$=0.99) due to the varactor control voltage droop.

According to (2) varactor capacitance will change for $\in$=1.027, or 2.7%. For example varactor one can assume $\alpha \approx 0.22$ V/pF, for small segment around 1.3V. Additionally, for the same varactor reverse current is 0.3 pA, around control voltage of 1V at 28° C. Further, let assume capacitances of C3=4700 pF and C1=300 pF. Then, based on above considerations, time needed between two successive refresh cycles is:

$$\Delta t_v = 585 \text{ s}.$$

Thus, every 585 s DAC with programmed register should be turned on (S1 and S4) for a short interval of time to recover charge loss (of 2.7%) on the circuitry capacitances. In implemented embodiments, such considerations may provide predetermined intervals for tuning voltage refresh.

Figure 8:
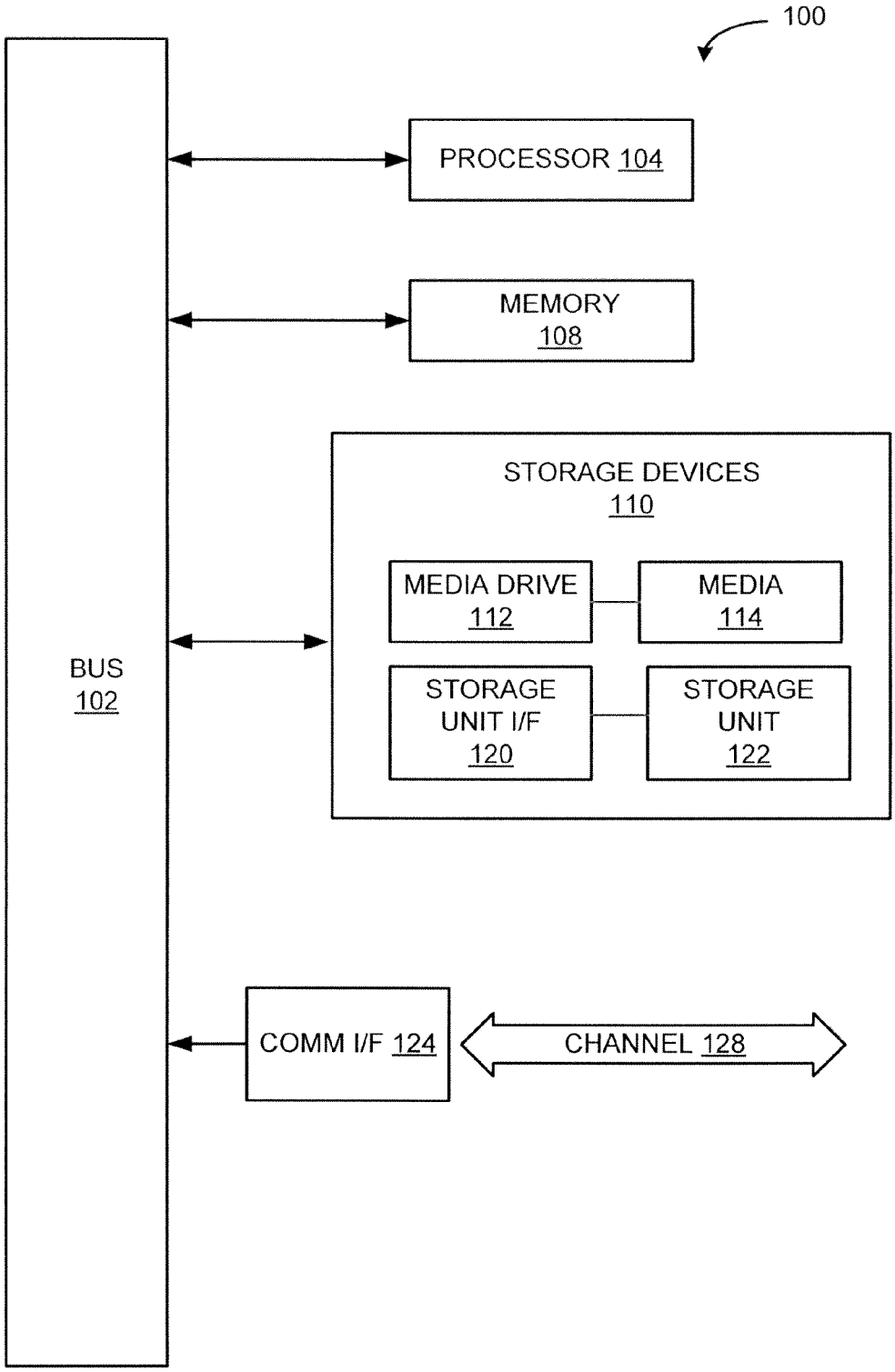
FIG. 8 illustrates an example computing module that may be used in implementing various features of embodiments of the invention.

As used herein, the term module might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the invention are implemented in whole or in part using software, in one embodiment, these software elements can be implemented to operate with a computing or processing module capable of carrying out the functionality described with respect thereto. One such example computing module is shown in FIG. 8. Various embodiments are described in terms of this example-computing module 100. After reading this description, it will become apparent to a person skilled in the relevant art how to implement the invention using other computing modules or architectures.

Referring now to FIG. 8, computing module 100 may represent, for example, computing or processing capabilities found within desktop, laptop and notebook computers; handheld computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 100 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 100 might include, for example, one or more processors, controllers, control modules, or other processing devices, such as a processor 104. Processor 104 might be implemented using a general-purpose or special-purpose processing engine such as, for example, a microprocessor, controller, or other control logic. In the illustrated example, processor 104 is connected to a bus 102, although any communication medium can be used to facilitate interaction with other components of computing module 100 or to communicate externally.

Computing module 100 might also include one or more memory modules, simply referred to herein as main memory 108. For example, preferably random access memory (RAM) or other dynamic memory, might be used for storing information and instructions to be executed by processor 104. Main memory 108 might also be used for storing temporary variables or other intermediate information during execution of instructions to be executed by processor 104. Computing module 100 might likewise include a read only memory ("ROM") or other static storage device coupled to bus 102 for storing static information and instructions for processor 104.

The computing module 100 might also include one or more various forms of information storage mechanism 110, which might include, for example, a media drive 112 and a storage unit interface 120. The media drive 112 might include a drive or other mechanism to support fixed or removable storage media 114. For example, a hard disk drive, a floppy disk drive, a magnetic tape drive, an optical disk drive, a CD or DVD drive (R or RW), or other removable or fixed media drive might be provided. Accordingly, storage media 114 might include, for example, a hard disk, a floppy disk, magnetic tape, cartridge, optical disk, a CD or DVD, or other fixed or removable medium that is read by, written to or accessed by media drive 112. As these examples illustrate, the storage media 114 can include a computer usable storage medium having stored therein computer software or data.

In alternative embodiments, information storage mechanism 110 might include other similar instrumentalities for allowing computer programs or other instructions or data to be loaded into computing module 100. Such instrumentalities might include, for example, a fixed or removable storage unit 122 and an interface 120. Examples of such storage units 122 and interfaces 120 can include a program cartridge and cartridge interface, a removable memory (for example, a flash memory or other removable memory module) and memory slot, a PCMCIA slot and card, and other fixed or removable storage units 122 and interfaces 120 that allow software and data to be transferred from the storage unit 122 to computing module 100.

Computing module 100 might also include a communications interface 124. Communications interface 124 might be used to allow software and data to be transferred between computing module 100 and external devices. Examples of communications interface 124 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 124 might typically be carried on signals, which can be electronic, electromagnetic (which includes optical) or other signals capable of being exchanged by a given communications interface 124. These signals might be provided to communications interface 124 via a channel 128. This channel 128 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 108, storage unit 120, media 114, and channel 128. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 100 to perform features or functions of the present invention as discussed herein.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. An auto tuning system for an antenna, comprising:

an electrical interconnect configured to connect to an antenna having a tunable capacitive load, the tunable capacitive load being tunable in response to an applied DC signal voltage;

a transmitter coupled to the electrical interconnect and configured to output a calibration signal to the antenna via the electrical interconnect;

a signal strength determination module coupled to the electrical interconnect and coupled to a tuning module, and configured to measure power reflected from the antenna when the transmitter outputs the calibration signal to the antenna;

the tuning module coupled to the electrical interconnect and coupled to the signal strength determination module, the tuning module configured to intermittently provide a DC signal voltage to the antenna to control the tunable capacitive load, the DC signal voltage determined in response to the measured power from the signal strength determination module; and a storage capacitor coupled to the tuning module and coupled to the electrical interconnect, the storage capacitor configured store the DC signal voltage provided by the tuning module and provide the stored DC signal voltage to the antenna when the tuning module does not provide the DC signal voltage.

2. The auto tuning system of claim 1, further comprising a control voltage determination module coupled to the signal strength determination module and configured to provide a digital signal to the tuning module according to the measured power determined by the signal strength determination module.

3. The auto tuning system of claim 1, further comprising a switch coupled to the tuning module in series with the capacitor and in series with the electrical interconnect and configured to disconnect the tuning module when the tuning module does not provide the DC signal voltage.

4. The auto tuning system of claim 1, further comprising a directional coupler coupled to the transmitter, the tuning module, the storage capacitor, the electrical interconnect, and the signal strength determination module.

5. The auto tuning system of claim 1, further comprising the antenna having the tunable capacitive load coupled to the electrical interconnect, the antenna comprising:

an interconnecting rail having a first end and a second end;

a grounding element extending from the interconnecting rail at the first end, the grounding element coupled to an electrical ground;

a matching element extending from the interconnecting rail at the second end, the matching element coupled to a varactor, the varactor capacitively coupling the matching element to the electrical ground; and a feed element extending from the interconnecting rail from a location on the interconnecting rail between the first end and the second end.

6. The auto tuning system of claim 5, the antenna further comprising:

a decoupling capacitor coupled to the feed element and the electrical interconnect;

a loading capacitor coupled to and interposed between the matching element and the varactor;

a DC decoupling inductor coupled between and in series with the electrical interconnection and the varactor.

7. A method, comprising:

outputting a calibration signal to an antenna having a tunable capacitive load;

measuring reflected power from the antenna produced while outputting the calibration signal;

using a tuning module, outputting a DC signal voltage to the antenna to tune the capacitive load of the antenna in response to the measured reflected power;

using the tuning module, charging a storage capacitor with the DC signal voltage;

halting output of the DC signal voltage using the tuning module; and outputting the DC signal voltage stood on the storage capacitor while the tuning module is not outputting the DC signal voltage.

8. The method of claim 7, wherein the DC signal voltage is determined by iteratively adjusting a potential DC signal voltage and iteratively measuring the reflected power.

9. The method of claim 8, wherein the DC signal voltage is determined using a binary search applied to the iterative measurements of the reflected power.

10. The method of claim 8, further comprising:

storing a signal value corresponding to the DC signal voltage; and re-initiating output of the DC signal voltage using the tuning module using the stored signal value corresponding to the DC signal voltage.

11. The method of claim 10, further comprising storing a reflected power measurement value corresponding to the reflected power produced using the DC signal voltage corresponding the signal value.

12. The method of claim 11, further comprising, during a subsequent operational period:

re-outputting the calibration signal to the antenna while applying the DC signal voltage to the antenna, and comparing a subsequent measurement of the reflected power produced during the re-outputting of the calibration signal to the stored reflected power measurement value.

13. The method of claim 12, further comprising, during the subsequent operational period, re-determining a subsequent DC signal voltage if the subsequent measurement of the reflected power differs from the stored reflected power measurement value by a predetermined amount.

14. The method of claim 10, wherein the step of re-initiating output of the DC signal voltage using the tuning module is repeated at predetermined time intervals.

* * * * *